US005261834A

United States Patent [19]

Yamanashi

[11] Patent Number: 5,261,834

[45] Date of Patent: Nov. 16, 1993

[54] CONNECTOR

[75] Inventor: Makoto Yamanashi, Shizuoka, Japan

[73] Assignee: Yazaki Corporation, Tokyo, Japan

[21] Appl. No.: 827,393

[22] Filed: Jan. 29, 1992

[30] Foreign Application Priority Data

Feb. 6, 1991 [JP] Japan ..... 3-10350[U]

[51] Int. Cl.[5] ..... H01R 13/428

[52] U.S. Cl. ..... 439/595; 439/599; 439/752

[58] Field of Search ..... 439/595, 598, 599, 603, 439/752

[56] References Cited

U.S. PATENT DOCUMENTS 4,690,478 9/1987 Rahrig et al. ..... 439/595

FOREIGN PATENT DOCUMENTS 59-86171 5/1984 Japan .
2-1025 1/1990 Japan .
2-14137 4/1990 Japan .

*Primary Examiner*—Paula A. Bradley

*Attorney, Agent, or Firm*—Sughrue, Mion, Zinn, Macpeak & Seas

[57] ABSTRACT

The present invention is directed to a connector in which terminals are inserted into and retained to a connector housing, and the alignment of the terminal can be made accurately when assembling the connector, and the assembling operation can be done easily. A base plate portion 4 of the male terminal 1 is bent into a channel-shaped transverse cross-section to provide a pair of side walls 4*a* and 4*a*. A retaining hole 4*c*, which can be engaged with a retaining projection 8 which is formed upright on the housing 2 and has a retaining pawl 8*a* at its distal end, is formed through a bottom plate 4*b*, thereby providing retaining means. Inner partition walls 10 and 11 and outer partition walls 10*b* and 11*b* for defining terminal receiving chambers are formed upright on a bottom plate 9 of the housing base 2, and engagement projections 10*a* and 11*a* for engagement with upper ends of the side walls 4*a* and 4*a* are formed respectively on inner surfaces of these partition walls at upper end portions thereof, and extend in the longitudinal direction of these partition walls.

4 Claims, 6 Drawing Sheets

CONNECTOR

BACKGROUND OF THE INVENTION

1. Field of the Invention

This invention relates to a connector of the type in which terminals are inserted into and retained on a housing base, and the housing base is inserted into and releaseably retained on a connector housing.

2. Prior Art

FIG. 6 is a perspective view of a conventional construction of such housing base or the like, in which reference character denotes a male terminal, reference character b denotes a housing base for retaining the male terminal a, and reference character c denotes a female housing for receiving the housing base b.

A base plate portion d of the male terminal a has at one end an electrical connection portion e to which a lead wire g is connected, and also has at the other end a tongue f serving as an electrical contact portion. Formed through the base plate portion d is an engagement hole 1 in which a pair of retaining pieces i (later described) formed upright on a bottom plate h of the housing base b are adapted to be engaged.

The housing base b serves as a partition frame for defining terminal receiving chambers in the female housing c, and two pairs of retaining pieces i are formed upright on the bottom plate h, and a pair of partition walls m interconnected by a rear stop, wall k are formed upright on the bottom plate h. Terminal stop walls n are formed integrally on the front end of the bottom plate h. Flexible retaining pieces p formed integrally with the bottom plate h serve as retaining means which are engaged with engagement portions g of the housing c upon insertion of the housing base b into the housing c.

With the above construction, in use, the partition wall m is disposed only on one side of the male terminal a, and the prevention of the rattling of the male terminal a depends only on the front terminal stop walls n, and it is difficult to align the terminal. In addition, there is no means for confirming whether or not the engagement hole 1 of the male terminal a is completely engaged with the retaining pieces i of the housing base b, and each of the male terminals a has been manually attached to the housing base b. Further, the base plate portion d, having the engagement hole j for engagement with the retaining pieces i of the housing base b, is bent twice its lateral edge portions, and the base plate portion d has an increased size because of this construction.

SUMMARY OF THE INVENTION

With the above problems of the prior art in view, it is an object of this invention to provide a connector in which terminals of the connector can be attached to a housing base in such a manner as not to be subjected to rattling, and an incomplete fitting of the terminal can be easily found, and the efficiency of the terminal attaching operation can be enhanced.

The above object has been achieved by a connector wherein a terminal is retained on a housing base which can be fitted in and removed from a connector housing and is constituted by a terminal receiving chamber partition frame, and said housing base is fitted in said connector housing; CHARACTERIZED in that a retaining projection, as well as opposed partition walls surrounding said retaining projection, are formed upright on a terminal receiving chamber bottom plate of said housing base; engagement projections are formed integrally at end portions of said partition walls, respectively; a base plate portion of said terminal is bent so that its lateral edges can be engaged with said engagement projections, respectively; and a retaining hole for engagement with said retaining projection is formed through a bottom plate of said base plate portion whereby said terminal can be retained on said housing base in a completely-retained condition via a provisionally-retained condition.

DESCRIPTION OF THE PREFERRED EMBODIMENT

Figure 1:
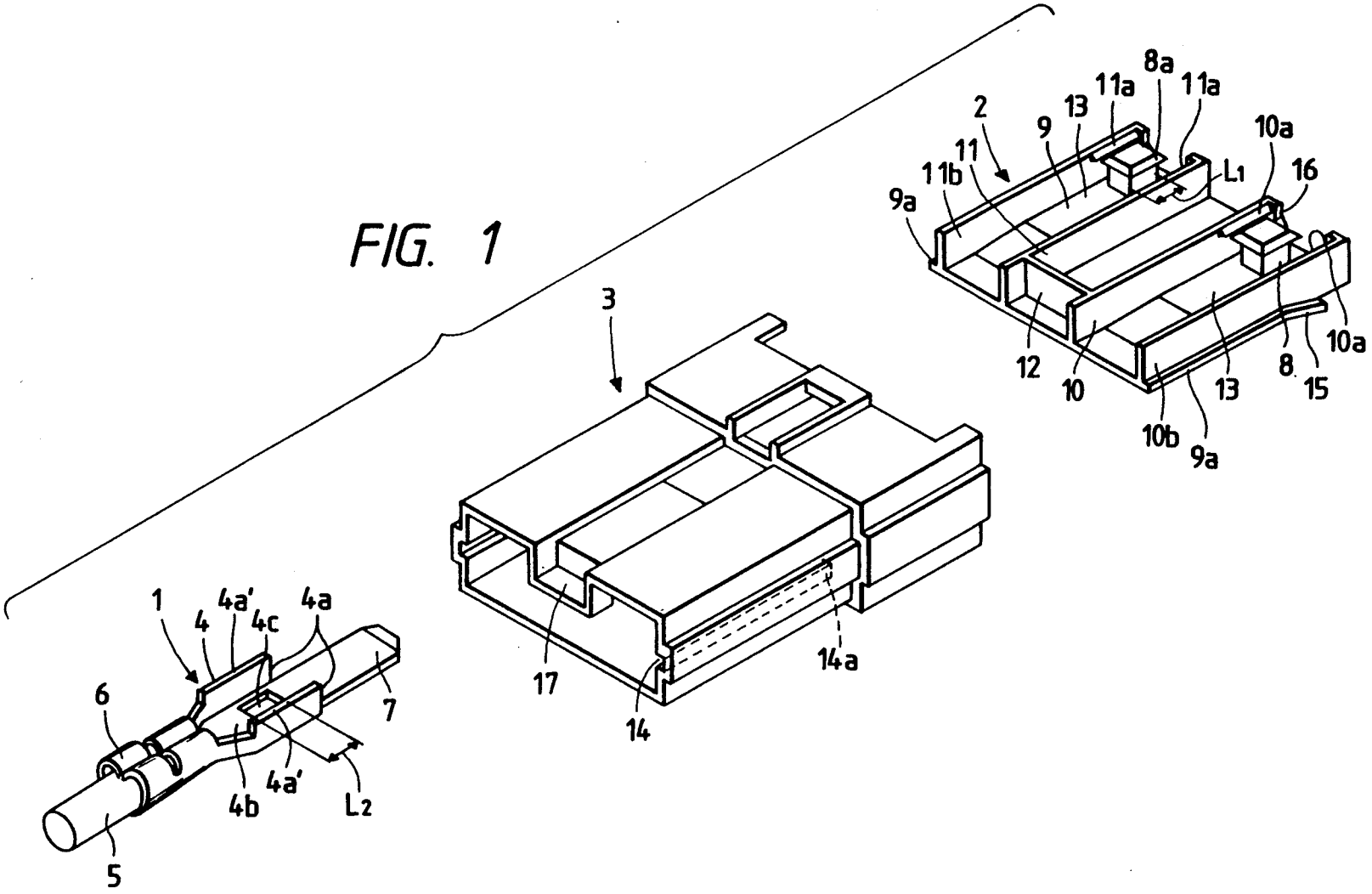
FIG. 1 is a perspective view of a female connector of the present invention in its disassembled condition.
Figure 2:
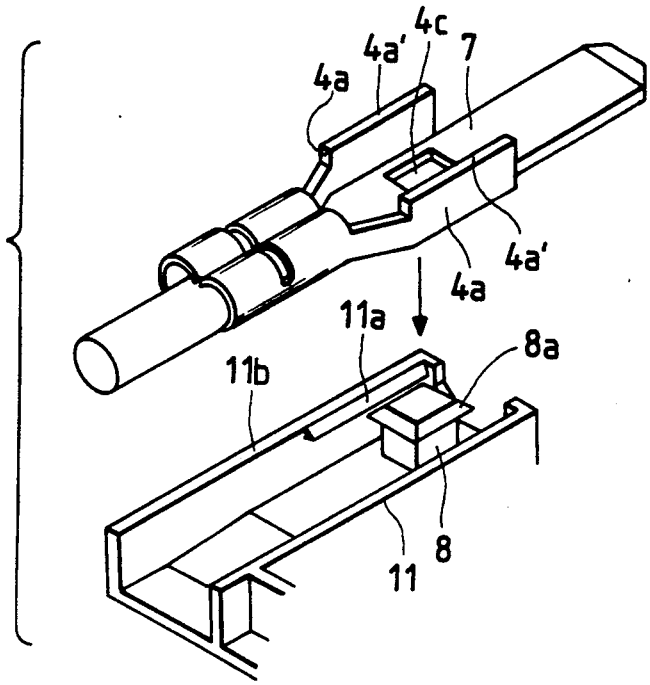
FIG. 2 is a perspective view showing a male terminal 1 and an important portion of a housing base 2.

FIG. 1 is a perspective view of a female connector of the present invention in its disassembled condition. Reference numeral 1 denotes a male terminal, reference numeral 2 a housing base of a synthetic resin for retaining the male terminal 1, and reference numeral 3 a female housing of a synthetic resin for receiving the housing base 2. FIG. 2 is a perspective view, showing the male terminal 1 and a portion of the housing base 2.

A base plate portion 4 of the male terminal 1 has at one end an electrical connection portion 6 to which a lead wire 5 is connected, and also has at the other end a tongue 7 serving as an electrical contact portion. The base plate portion 4 is bent into a channel-shaped transverse cross-section to provide a pair of side walls 4*a* and 4*a*, and a bottom plate 4*b* has retaining means defined by a retaining hole 4*c* for engagement with a retaining projection 8 (later described) which is formed upright on the housing base 2 and has a retaining pawl 8*a* at its distal end.

The housing base 2 serves as a partition frame for defining terminal receiving chambers 13 in the female housing 3. This housing base is separate from the female housing 3 so that the former can be releaseably attached to the latter. The housing base 2 has inner partition walls 10 and 11 for the right and left terminal receiving chambers which walls are formed on a bottom plate 9, these inner partition walls being interconnected by a rear stop wall 12. Outer partition walls 10*b* and 11*b* are formed upright on the outer edge portions of the bottom plate 9, respectively. These inner and outer partition walls form the terminal receiving chambers 13. The retaining projection 8 is formed upright on the bottom plate 9 generally at the centerline of each terminal receiving chamber 13, and serves as retaining means for engagement with the retaining hole 4c of the male terminal 1. Longitudinally-continuous engagement projections 10a are formed respectively on those portions of the inner and outer partition walls 10 and 10b which are disposed at the upper portion of the terminal receiving chamber in opposed relation to the retaining projection 8. Longitudinally-continuous engagement projections 11a are formed respectively on those portions of the inner and outer partition walls 11 and 11b which are disposed at the upper portion of the terminal receiving chamber in opposed relation to the retaining projection 8. These longitudinal engagement projections serve as retaining means for engagement with upper edges 4a' and 4a' of the side walls 4a and 4a of the base plate portion 4 when the male terminal 1 is completely retained on the housing base 2, as later described (see FIG. 4). The width $L_1$ of the retaining projection 8 is generally equal to the length $L_2$ of the retaining hole 4c. Formed respectively in the inner surfaces of the side walls of the female housing 3 are engagement grooves 14 in which projected lateral edges 9a of the bottom plate 9 of the housing base 2 are engaged, respectively, when the housing base 2 is fitted in the female housing 3. An engagement wall 14a, which cooperates with a flexible retaining piece 15 (which is formed on the projected lateral edge 9a of the bottom plate 9 of the housing base 2) to provide retaining means, is formed integrally at the end of the engagement groove 14. A front wall 16 is formed integrally on the bottom plate 9 at the front end of the terminal receiving chamber 13, and serves as means for preventing a forward withdrawal of the male terminal 1. A rearward withdrawal prevention portion 17 of a channel-shaped transverse cross-section is formed integrally on the rear end of the female housing 3, and serves as means for preventing a rearward withdrawal of the housing base 2 fitted in the female housing 3.

Figure 3:
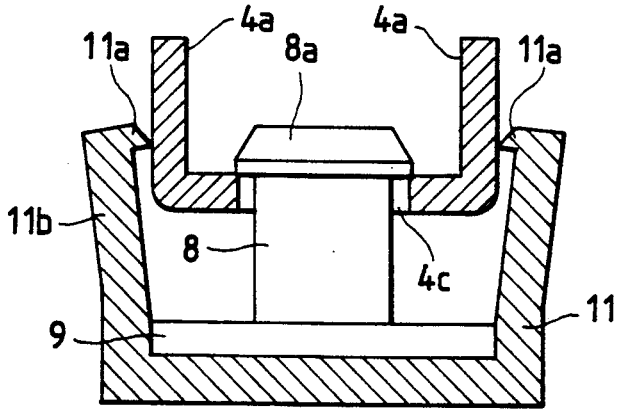
FIG. 3 is a transverse cross-sectional view of the male terminal 1 in a provisionally-retained condition.
Figure 4:
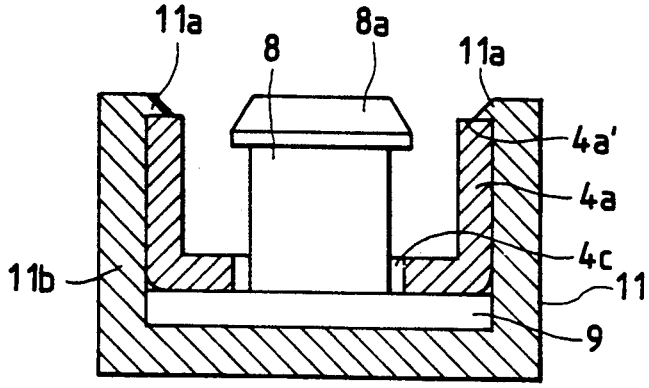
FIG. 4 is a transverse cross-sectional view of the male terminal 1 in a completely-retained condition.
Figure 5:
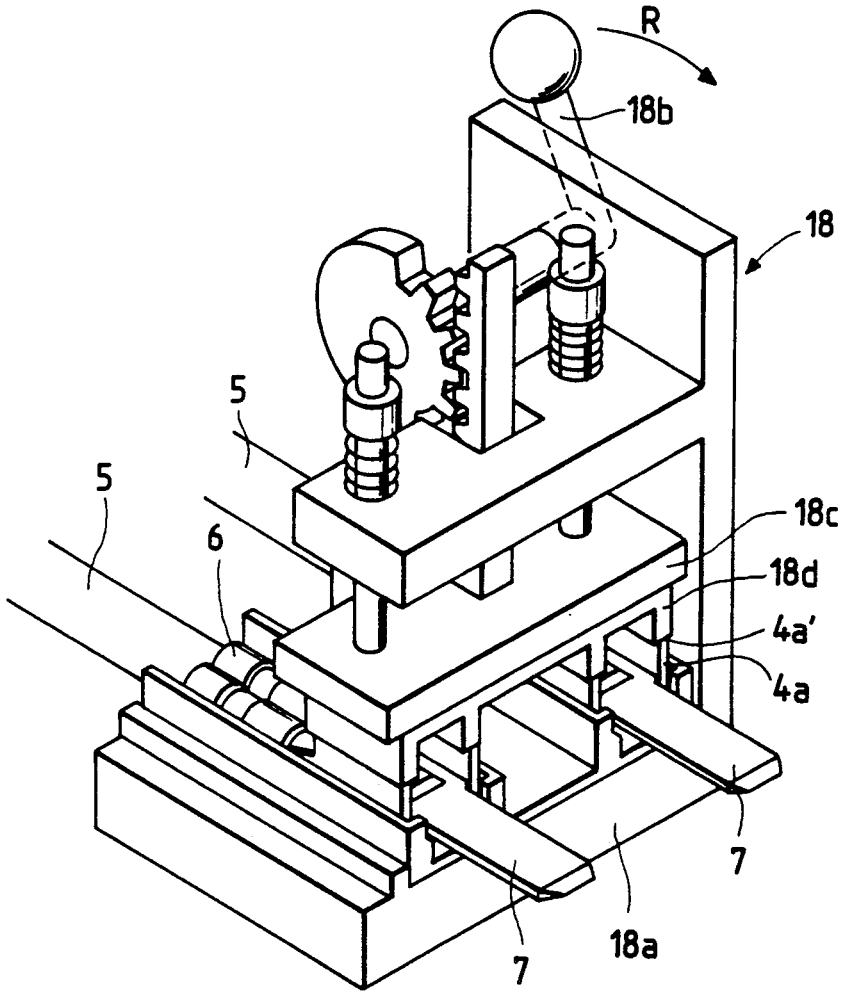
FIG. 5 is a view showing the attachment of the male terminals, using a jig.
Figure 6:
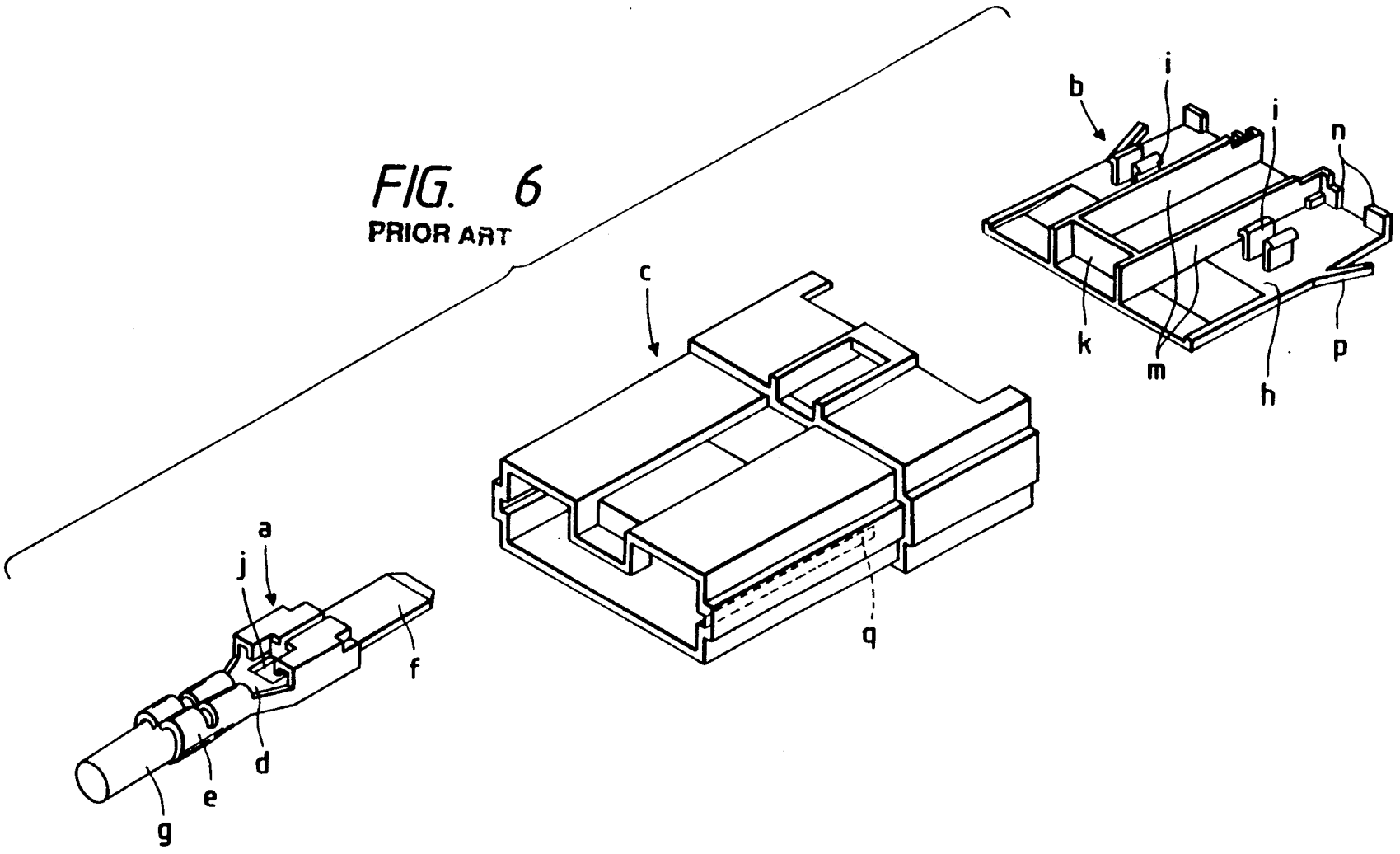
FIG. 6 PRIOR ART
FIG. 6 is an exploded perspective view of a conventional construction.
Figure 7:
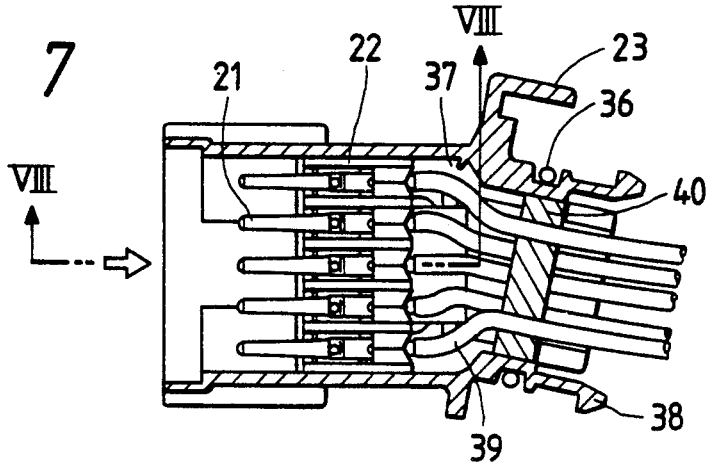
FIG. 7 is a partially cross-sectional view showing another connector according to the present invention.
Figure 8A:
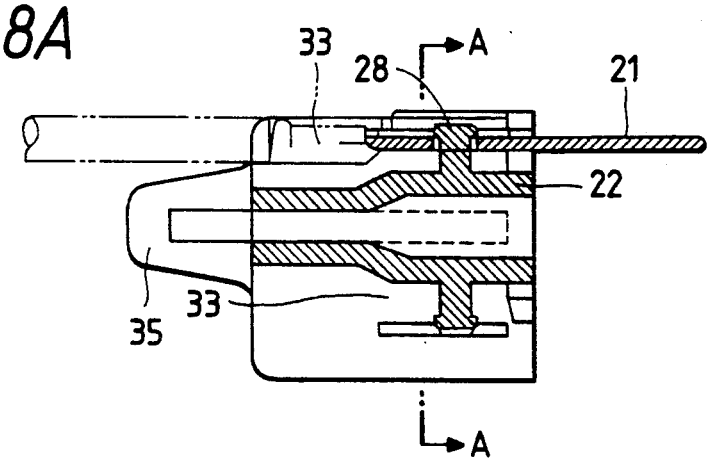
FIG. 8A is a cross-sectional view taken along line VIII—VIII in FIG. 7, which illustrates the male terminal 21 in a provisionally-retained condition.
Figure 8B:
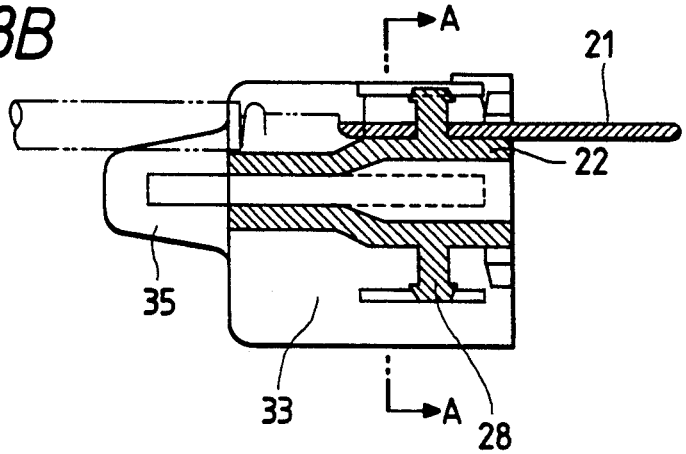
FIG. 8B is a cross-sectional view taken along line VIII—VIII in FIG. 7, which illustrates the male terminal 21 in a completely-retained condition.

In use, the male terminal 1, having the lead wire 5 connected thereto as shown in FIG. 2, is passed through the female housing 3, and then the retaining hole 4c of the male terminal 1 is fitted on the retaining projection 8 of the housing base 2 in a provisionally-retained condition from the upper side. In this condition, as shown in FIG. 3, the outer surfaces of the side walls 4a and 4a of the base plate portion 4 slightly urge the engagement projections 10a (11a) of the inner and outer partition walls 10 and 10b (11 and 11b) away from each other, so that the base plate portion 4 is held in this condition. Then, the housing base 2, on which the male terminal 1 has been set in the provisionally-retained condition as described above, is set on a bed 18a of a terminal setting jig 18 shown in FIG. 5. When a handle 18b of the terminal setting jig 18 is rotated in a counterclockwise direction R, a pressing portion 18c descends, so that blades 18d on a lower surface thereof simultaneously urge the upper edges 4a' and 4a' of the side walls 4a and 4a of the base, plate portion 4 downward. As a result, a bottom plate 4b of the base plate portion 4 is abutted against and stopped by the bottom plate 9 of the housing base 2, as shown in FIG. 4. This condition is a completely-retained condition. Then, the housing base 2, to which the male terminals 1 have been attached in the completely-retained condition, is inserted into the female housing 3 for fitting connection thereto. Therefore, the projected lateral edges 9a of the bottom plate 9 of the housing base 2 slidingly move respectively along the engagement grooves 14 of the female housing 3. At the end of this movement, the rear stop wall 12 of the housing base 2 is abutted against and stopped by the rear withdrawal prevention portion 17 of the female housing 3, and the flexible retaining pieces 15, formed on the projected lateral edges 9a of the bottom plate 9 of the housing base 2, are engaged with the engagement walls 14a provided at the ends of the engagement grooves 14 of the female housing 3, thereby completing the assembling of the connector.

With the above construction of the present invention, when the base plate portions 4 of the male terminals 1 are to be attached to the housing base 2, they can be set by the terminal setting jig 18 at a time, and therefore the operation efficiency is very good, and an incomplete fitting of the base plate portion 4 on the retaining projection 8 is eliminated. If the incomplete fitting of the base plate portion 4 on the retaining projection 8 should occur, this incomplete fitting can be discovered at a glance, since the engagement projections 10a or 11aof the housing base 2 do not overlie the upper edges 4a' and 4a' of the side walls 4a and 4a of the base plate portion 4.

FIGS. 7–10 show another arrangement of the connector according to the present invention. A housing base 22 has inner and outer partition walls 30a and 30b at both sides thereof for defining a plurality of terminal retaining chambers 33. Each of the outer partition walls 30b is provided at one side thereof with a longitudinal-continuous engagement projection 31b projecting toward corresponding one of the terminal retaining chambers 33, and each of the inner partition walls 30a is provided at both sides thereof with two longitudinal-continuous engagement projections 31a projecting toward adjacent two chambers 33. A retaining projection 28 which has the same configuration as that of the former embodiment is provided within each of the terminal retaining chamber 33. According to the above-arrangement, the housing base of this embodiment 22 can accommodate a plurality of terminals 21, which has the same configuration as that of the former embodiment, thereon at both sides thereof.

Figure 9:
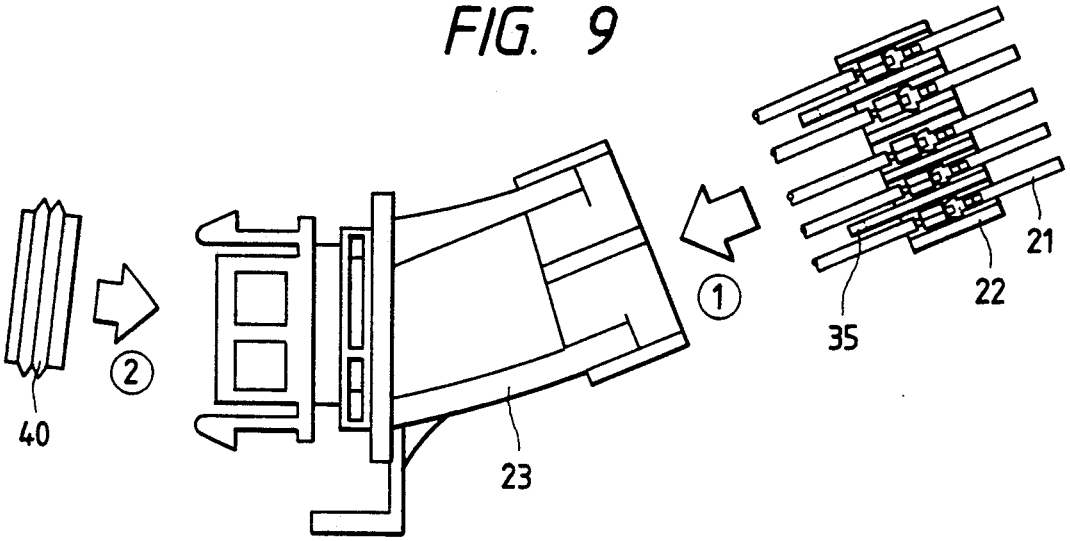
FIG. 9 is a view showing assembling manner of the connector shown in FIG. 7.
Figure 10:
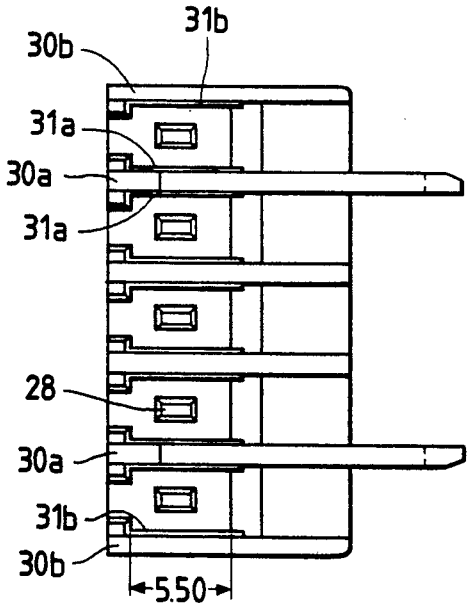
FIG. 10 is a plan view showing the housing base 22 shown in FIG. 7.

As shown in FIG. 9, the housing base 22 onto which the terminals 21 are retained is inserted into a housing 23 and fixed thereto by means of locking arms 35 and retaining projections provided inside the housing 23 but not shown in the drawings. Then, filler materials 37 such as resins are filled into a space behind the thus fixed housing base 22, and then a rubber member 40 is fitted to the inside of the housing 23 behind the filler materials 37 to provide sealing property inside the housing 23. A rubber member 36 is fitted onto the outside of the housing 23.

The female connector thus constructed is securely attached to, for example, a transmission case of an automotive vehicle by means of fixing legs 38 and a fixing hole provided on the case. The rubber member 38 provides the sealing property between the outside of the housing and the hole of the transmission case to prevent an oil leak through the outside of the housing. The filler materials 37 and the rubber member 40 also prevent an oil leak through the inside of the housing, and especially, prevents oil led along electric wires 39 from reaching the inside of the housing 23.

In each embodiment of the present invention, although the connector in which the male terminals and the female housing are combined together has been described, the invention can be applied to a connector of the type in which female terminals and a male housing are combined together.

With the above construction of the present invention, the terminal is retained in such a manner that the side walls of the base plate portion of the terminal are held by the inner and outer partition walls from the opposite sides. Therefore, the rattling of the terminal is eliminated, and the efficiency of attachment of the terminal to the housing base is enhanced, and its incomplete fitting can be confirmed at a glance.

What is claimed is:

1. A connector wherein a terminal having opposing side walls is retained on a housing base which can be fitted in and removed from a connector housing and is constituted by a terminal receiving chamber partition frame, and said housing base is fitted in said connector housing; CHARACTERIZED in that a retaining projection, as well as opposing partition walls surrounding said retaining projection are formed upright on a terminal receiving chamber bottom plate of said housing base; engagement projections are formed integrally at end portions of said partition walls, respectively for engaging distal ends of said side walls; a base plate portion of said terminal is bent so that its lateral edges can be engaged with said engagement projections, respectively; and a retaining hole for engagement with said retaining projection is formed through a bottom plate of said base plate portion wherein said terminal can be retained on said housing base in a provisionally-related condition whereat said partition walls are deflected outwardly by said side walls and a completely retained position whereat said projections engage said distal ends of said side walls.

2. A connector comprising:

at least one terminal, each including a base plate portion bent into a channel-shaped transverse cross-section to provide a pair of side walls, and a retaining hole formed through a bottom of said base plate portion;

a housing base including a bottom plate, at least one pair of partition walls formed upright from said bottom plate for defining a terminal receiving chamber between said partition walls of each pair, at least one retaining projection formed upright from said bottom plate between said partition walls of each pair for engagement with said retaining hole of corresponding terminal and at least one pair of engagement projections formed respectively on said partition walls of each pair for spring-like engagement with distal ends of said side walls of a corresponding terminal to retain the terminal within corresponding terminal receiving chamber;

a connector housing for accommodating said housing base retaining said at least one terminal thereon; and means for removably fixing said housing base onto said connector housing.

3. The connector according to claim 2, wherein opposed partition walls of each two adjacent pair further defines a second terminal receiving chamber, each second terminal receiving chamber having a retaining projection formed upright from said bottom plate between said opposed partition walls of each two adjacent pair for engagement with said retaining hole of corresponding terminal, and a pair of engagement projections formed respectively on said opposed partition walls of each two adjacent pair for engagement with distal ends of said side walls of corresponding terminal to retain the terminal within corresponding second terminal receiving chamber.

4. The connector according to claim 2, wherein a plurality of terminal receiving chambers are defined at both sides of said bottom plate.

* * * * *